US006968821B2

(12) United States Patent
Otsuki

(10) Patent No.: US 6,968,821 B2
(45) Date of Patent: Nov. 29, 2005

(54) MODEL ENGINE STARTER

(75) Inventor: Naohiko Otsuki, Tokyo (JP)

(73) Assignee: Kyosho Corporation, Tokyo (JP)

( * ) Notice: Subject to any disclaimer, the term of this patent is extended or adjusted under 35 U.S.C. 154(b) by 0 days.

(21) Appl. No.: 10/862,328

(22) Filed: Jun. 8, 2004

(65) Prior Publication Data

US 2005/0211216 A1 Sep. 29, 2005

(30) Foreign Application Priority Data

Mar. 26, 2004 (JP) ..... 2004-091181

(51) Int. Cl.[7] ..... F02N 1/00
(52) U.S. Cl. ..... 123/185.2; 74/7 C; 192/42
(58) Field of Search ..... 123/185.2, 185.3, 123/DIG. 3; 74/7 C, 8, 6; 290/38 C; 192/42, 192/46

(56) References Cited

U.S. PATENT DOCUMENTS 1,178,788 A * 4/1916 Fillettaz ..... 123/185.3
3,114,270 A * 12/1963 Buxton et al. ..... 74/6
5,095,865 A * 3/1992 Keister ..... 123/179.5
6,857,331 B2 * 2/2005 Yeh ..... 74/7 C
2002/0139341 A1 * 10/2002 Tsuno ..... 123/185.3
2004/0065161 A1 * 4/2004 Yeh ..... 74/6
2004/0134293 A1 * 7/2004 Lai ..... 74/6

FOREIGN PATENT DOCUMENTS

JP U3093337 2/2003

* cited by examiner

*Primary Examiner*—Henry C. Yuen
*Assistant Examiner*—Arnold Castro
(74) *Attorney, Agent, or Firm*—Nixon & Vanderhye, P.C.

(57) ABSTRACT

A model engine starter assembly is provided which is capable of quickly relieving the engagement between the actuator and the coupling pin upon the start of the model engine and includes a starter shaft which carries a starter pin and defines a shaft axis, and a hub provided with a guide groove which is slanted at a predetermined angle with respect to the shaft axis. The hub has a bore in which a rearward end portion of the starter shaft is inserted for rotational movement relative to the hub. The starter pin is received within the slanted groove so as to move the starter shaft in the direction of the shaft axis in response to rotation of the shaft axis relative to the hub to thereby move an actuator attached to a forward end of the starter shaft into and out of engagement with a connecting pin of the model engine's crank shaft. The slanted groove is defined by a front guide face which terminates at an open end of the guide groove, a rear guide face opposed to the front guide face, and a transition face which extends between the rear guide face and the open end of the guide groove.

5 Claims, 5 Drawing Sheets

MODEL ENGINE STARTER

BACKGROUND OF THE INVENTION

The present invention relates to a model engine starter to be used for starting the model engine to drive a model car.

In the conventional model engine starter disclosed in Japanese Utility Model Registration No. 3093337, the sleeve (hub) is formed with a cutout having a pin actuating guide face to actuate a pin attached to the starter shaft such that said starter shaft is moved to bring a coupling member (coupling pin) mounted to the crankshaft of the model engine into engagement with an engagement recess formed in the coupling plate (drive section) so as to start the model engine.

When the model engine is started, the coupling member goes out of the engagement recess through a chamfered portion of the engagement recess to push slanting face of the coupling member such that the starter shaft is restored (moved) to the original position.

In the starter of said model engine, the sleeve is provided with a cutout having a guide face only for pushing the pin out. Therefore, it is required to make use of the chamfered portion and the slanting face in the coupling plate for restoring the starting shaft to the original position.

However, chamfering the engagement recess in the coupling plate to form a slanting face therein is so difficult that the cost is driven up.

Further, there is a need for providing a mechanism (a steel ball, a coil spring, a mounting screw or an accommodation bore) to set the initial position of the starting shaft for restoring the starting shaft to the initial position.

However, such structure requires an accommodation bore formed through the starting shaft, which can lessen the strength thereof. Further, since a bias means for retaining the rotary shaft from rotating until a predetermined load is exerted, there is a likelihood of the starting shaft rotating simultaneously with the revolution of the sleeve, making the start of the model engine impossible.

Further, the starting shaft is caused by the coupling member to rotate together with the crankshaft for some time period, generating a power loss to the model engine.

SUMMARY OF THE INVENTION

To solve the above problems, there is provided in one aspect of the invention a model engine starter comprising a rotary drive mechanism, a rotary body adapted to be rotated by said rotary drive mechanism, a hub formed with an inclined guide groove slanting at a predetermined angle with respect to an axis thereof, a starter shaft rotatably inserted into said hub, a pin mounted to said starter shaft and adapted to move along a front guide face and a rear guide face defining said inclined guide groove in the direction of the axis of the hub and an actuator provided at a leading end of said starter shaft and adapted to come into and out of engagement of a coupling pin provided at in the crankshaft of the model engine.

Said model engine starter is further characterized in that the rear guide face of the inclined guide groove remote from said coupling pin has a slanting rear guide face slanting at a predetermined angle with respect to an axis thereof and a parallel face extending in parallel to said axis to continue into the coupling pin side of said slanting guide face.

Said model engine starter is still further characterized in that said starter shaft is formed with a D-shaped cutout, a ball in slidable contact with the circumferential face inclusive of said D-shaped cutout of said starter shaft, bias means for urging said ball to the circumferential face inclusive of said D-shaped cutout of said starter shaft to prevent said hub and said starter shaft from rotating together when said drive section is not imparted with resistance.

Said model engine starter is still further characterized in that said drive section is provided in the form of an arm.

Said model engine starter is still further characterized in that said rotary drive mechanism is composed of a starter rope to rotate said rotary body and a return spring having an urging force stored up to rewind said starter rope upon the circumference of said rotary member when said starter rope is to be drawn out.

Said model engine starter is further characterized in that said rotary drive mechanism is composed of a motor and a transmission mechanism to transmit a turning force to said rotary member.

DESCRIPTION OF THE EMBODIMENTS

Figure 1:
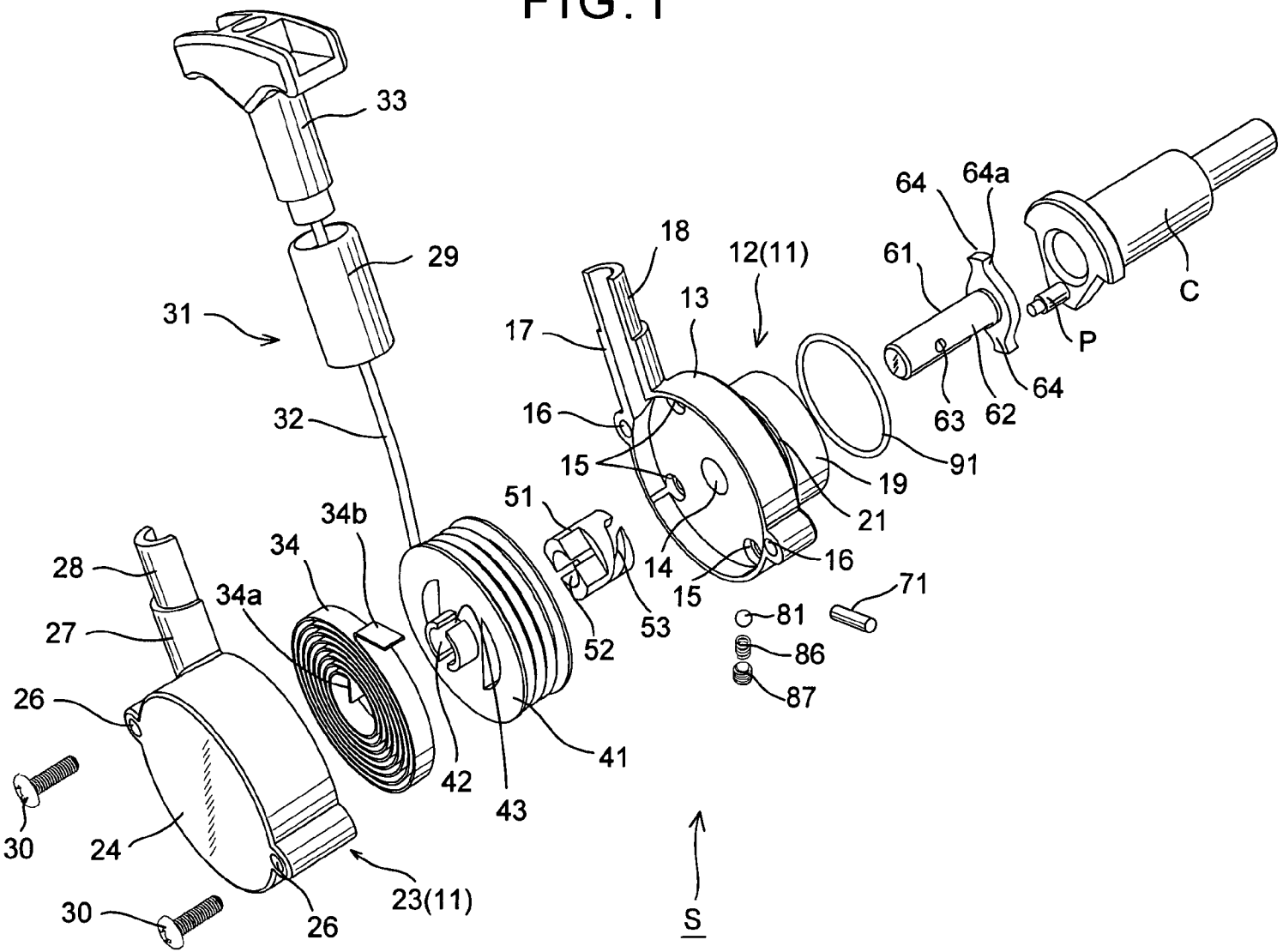
FIG. 1 is an exploded perspective view of one embodiment of the model engine starter according to the present invention.
Figure 2:
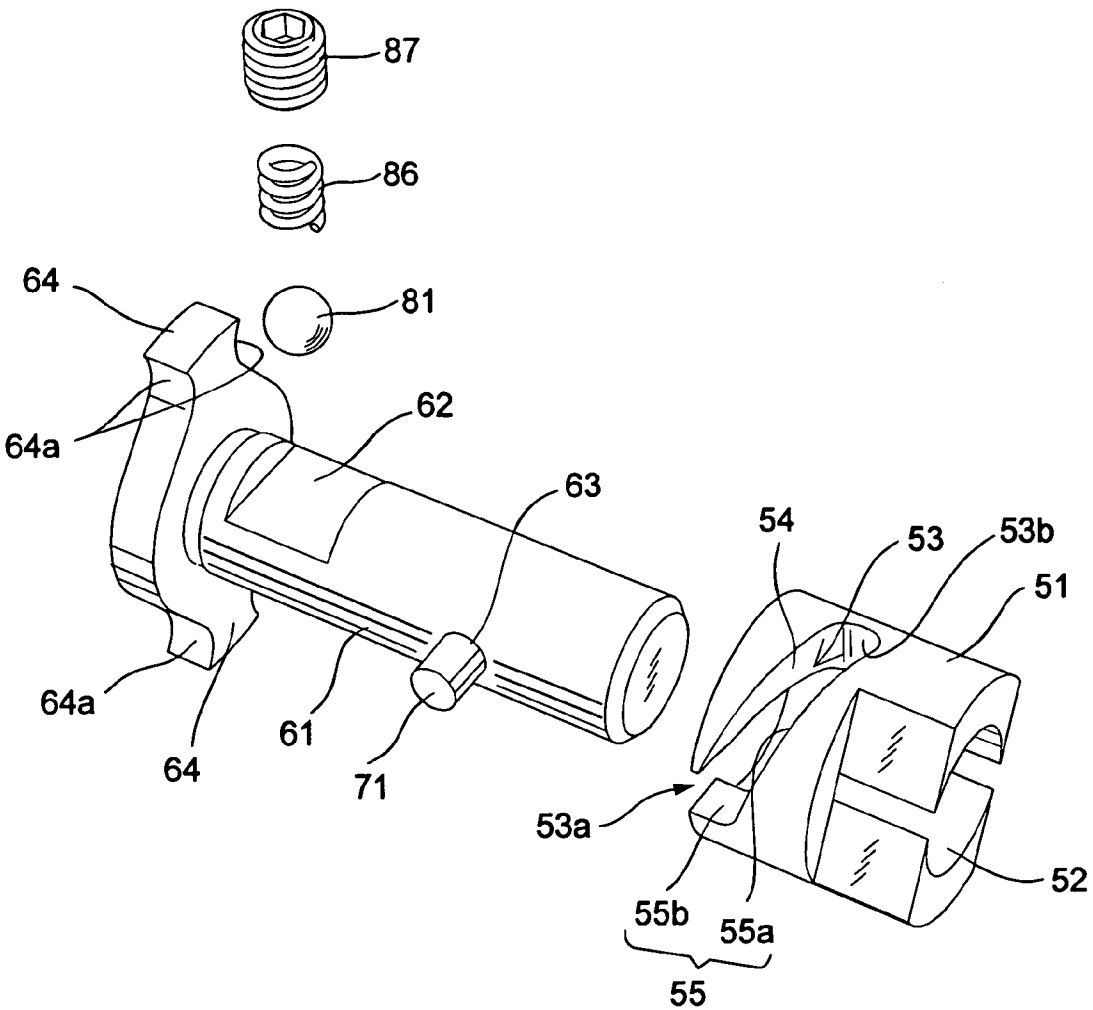
FIG. 2 is an enlarged perspective view of the hub, the starter shaft, the pin and the ball.

FIG. 1 is an exploded perspective view of the model engine starter according to one embodiment of the present invention; FIG. 2 is an enlarged perspective view of the hub, the starter shaft, the pin and the ball or the like are shown in an enlarged perspective view; and FIG. 3 and FIG. 4 show the respective components shown in FIG. 1 having assembled.

Figure 3:
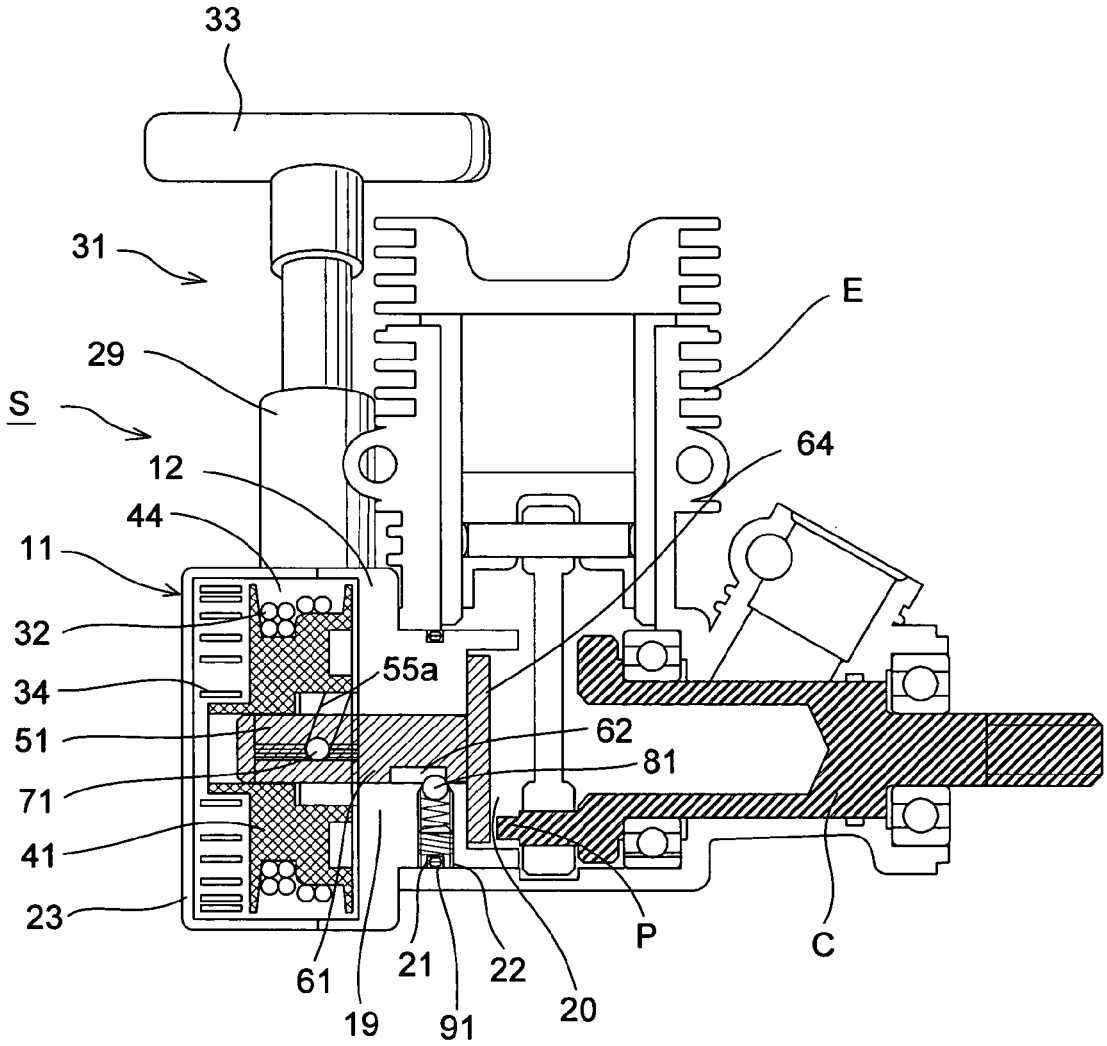
FIG. 3 is another cross section of the respective parts shown in FIG. 1 being mounted to the model engine.
Figure 4:
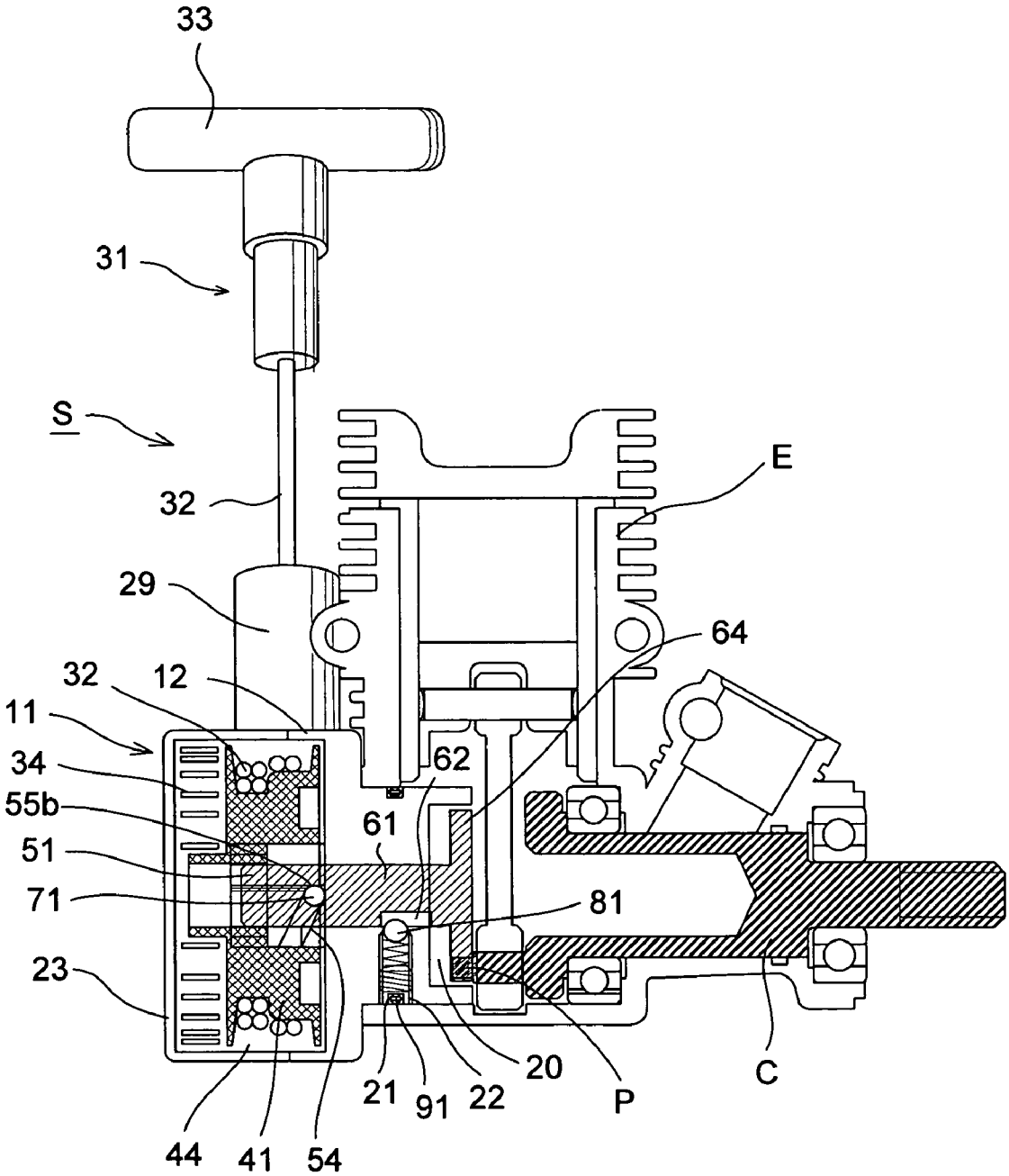
FIG. 4 is a cross section of the respective parts shown in FIG. 1 being mounted to the model engine.

It is to be noted in this connection that FIG. 3 shows the model engine before the start thereof while FIG. 4 said model engine being started.

In FIG. 1, the starter S in the form of one embodiment of the invention to start the model engine E is composed of a housing 11, a rotary drive mechanism 31, a pulley 41 in the form of a rotary member to be rotated by said rotary drive mechanism 31, a hub 51 formed with an inclined guide groove 53 axially slanting at a predetermined angle with respect to an axis thereof, a starter shaft 61 rotatably extending through said hub 51, a pin 71 adapted to axially move in the hub 51 along a forward guide face 54 and a rearward guide face 55 which define said inclined guide groove 53, an actuator arm 64 adapted for engagement with and disengagement out of a connecting pin P provided in the crankshaft C of the model engine E, a ball 81 accommodated in a screw hole 22 in the housing 11 to slidably contact a circumferential face of the starter shaft 61 including a D cut portion 62, a bias means to prevent the hub 51 and starter shaft 61 from rotating together when the actuator arm 64 is not implied with a resistance, and an O ring 91.

Said housing 11 is further composed of a front housing section 12, a rear housing section 23 provided in facing relation thereto, a coupling tube 29, fastening screws 30 to secure the rear housing portion 23 to said front housing portion 12.

Said front housing section 12 is further composed of a front bowl member 13, a front semicircular cylinder portion 17 integrally formed with said front bowl member 13 to tangentially extend therealong, a small diameter front semicircular cylinder portion 18 integrally formed with said front semicircular cylinder portion 17 and a cylindrical portion 19 coaxially formed with said front bowl member 13.

Said front bowl member 13 is formed with a bore 14 round in section to extend through said cylindrical portion 19, mounting holes 15 for attaching the housing 11 to the model engine E and a screw hole 16 to secure the rear housing section 23 to the front bowl member 13.

As shown in FIG. 3 and FIG. 4, said cylindrical portion 19 is further formed with a cylindrical recess 20 coaxially with said circular bore 14 formed on the other side of said front bowl member, a circumferentially extending O-ring groove 21 and a screw hole 22 to communicate from said O-ring groove 21 to the circular bore 14.

Next, the rear housing section 23 is composed of a rear bowl member 24, a rear semicircular cylinder portion 27 tangentially extending therealong in correspondence with said front semicircular cylinder portion 17 and a rear small diameter semicircular cylinder portion 28 in correspondence with said small diameter front semicircular cylinder portion 18.

Though not shown, said rear bowl member 24 is provided at an inner circumference thereof with an abutment to stop a return spring outside end 34*b* and a mounting hole 26 in correspondence with a screw hole 16 to secure the front bowl member 13 to the rear bowl member 24.

The inside diameter of the coupling tube 29 is equivalent to the outside diameters of the small diameter front semicircular cylinder portion 18 and the small diameter rear semicircular cylinder portion 28 coupled together while the outside diameter thereof is equivalent to the outside diameters of the front semicircular cylinder portion 17 and a rear semicircular cylinder portion 27 coupled together.

Next, there is provided a rotary drive mechanism 31 to rotate a pulley 41 provided as a rotary member. A starter rope 32 has one end thereof attached to said pulley 41 to rotate the same while the other end of said starter rope 32 is attached to the grip member 33. Said pulley 41 is provided with a return spring 34 which has, when the starter rope is drawn out, an urge stored up to wind said starter rope 32 back around the pulley 41.

Then, the return spring 34 has an inner pawl 34*a* to latch an inner engagement portion 43 at an inner portion thereof. On the other hand, the return spring 34 has an outer abutment 34*b* to abut against an outer engagement portion 25 provided at an outer portion thereof.

Next, said pulley 41 provided in the form of a rotating member is formed at a center thereof with a mounting hole 42 to receive therein a hub 51 such that said hub will not rotate therein. Said inner engagement portion 43 is provided at a rear end of said mounting hole to receive said inner pawl 34*a* of the return spring 34. Said pulley 41 is further formed therearound with a starter rope groove 44 having a starter rope amounting portion 45 at a portion of the starter rope groove 44.

Next, said hub 51 is centrally formed with a bore 52 to rotatably receive a starter shaft 61 and with an inclined guide groove 53 at a circumferential portion thereof.

The inclined guide groove 53 has a proximal open end 53*a* and a distal closed end 53*b*. The guide groove 53 is defined by a front guide surface provided by a front guide face 54 which is slated at a predetermined angle with respect to the axis of the starter shaft 61 and a rear guide face 55.

The rear guide face 55 includes a slanted rear guide face 55*a* slanting at a predetermined angle with respect to the axis of the starter shaft 61, and a transition face 55*b* at the open end 53*a* of the groove. The transition face 55*b* extends parallel to the starter shaft axis from the rear guide face 55*a* to the open end 53*a* of the groove 53. The slanted rear guide face 55*a* terminates at the transition face 55*b* so that the latter continues the guide surface of the former in a direction towards the connecting pin P. The front guide face 54, however, terminates at the open end 53*a* of the groove.

Next, the starter shaft 61 is formed with a cutout 62 longitudinally extending, rearwardly of which a blind hole 63 is formed for receiving a pin 71 while the actuator arm 64 is integrally formed forwardly thereof.

Then, said actuator arm is formed with constricted portions 64*a* to receive the connecting pin P.

Next, there is provided bias means which is composed of a ball 81 accommodated in the screw hole 22 formed in the housing 11, a coil spring 86 to urge said ball 81 to the circumferential surface of the starter shaft 61 formed with the D-shaped cutout 62 and a screw 87 adapted to be screwed in said screw hole 22 and adjust the urging force of the coil spring 86.

Next, the method of assembling the starter S will be explained.

First, the tip end of the starter shaft 61 opposite to the actuator arm 64 is inserted into the insertion hole 14 in the front housing section 12 from the cylindrical portion 19 thereof.

Next, the ball 81 first and then the coil spring 86 are successively inserted into the screw hole 22 before the screw 87 is screw into the screw hole 22 such that the ball 81 and the coil spring will not come out of the screw hole 22 while the urging force of the ball 81 against the starter shaft is adjusted.

Thus, with the ball 81 and the coil spring 86 being accommodated in the screw hole 22 and blocked by the screw 87 screwed thereinto, the starter shaft 61 is rotated with respect to the front housing section 12 to allow the ball 81 to be pushed into the D-shaped cutout 62, thus preventing the starter shaft 61 from coming off from the front housing section 12.

Next, the O-ring groove 21 in the front housing section 12 receives an O-ring 91 thereinto.

In this state, the cylindrical portion 19 of the front housing section 12 is inserted into the engine E before a gap between the front housing section 12 and the model engine E is sealed by the O-ring 91.

Said front housing section 12 is secured to the model engine E by screwing mounting screws (not shown) into screw holes 15 in the model engine E through the four mounting holes 15.

Next, the pin 71 is inserted, as shown in FIG. 2, into the mounting hole 63 of the starter shaft 61 which has been inserted into the cylindrical portion 19 and the front bowl member 13. Thereafter, the rear portion of the starter shaft 61 is oriented to face the open end 53*a* of the inclined guide groove 53 and inserted into said bore 52 such that the pin 71 is guided into the inclined guide groove 53 until the hub 51 is abutted against the front bowl member 13.

In this state, the hub 51 is inserted and accommodated in the mounting hole 42 in the pulley 41 with the starter rope wound around the starter rope groove 44 thereof while an unwound portion of the starter rope 32 is located within the front semicircular cylinder portion 17 and the small diameter front semicircular cylinder portion 18.

Then, by use of a predetermined jig, the inner pawl 34*a* of the return spring 34 is caused to latch the inner engagement portion 44 of the pulley 41 while the outer abutment 34*b* of the return spring 34 is urged to abut against an outer engagement portion provided in the rear bowl member 24. At this time, the rear semicircular cylinder portion 27 is coupled to the front semicircular cylinder portion 17 while the rear small diameter semicircular cylinder portion 28 is coupled to the small diameter front circular portion 18.

In this state, the return spring 34 is stored with an urging power to rewind the starter rope 32.

Next, two fastening screws 30 are inserted into the respective two mounting holes 26 until the threaded portions of the fastening screws 30 are screwed with the holes 16 in the front bowl member 13 to secure the rear bowl member 23 to the front bowl member 12.

Then, the combined small diameter front semicircular cylinder portion 18 and rear small diameter front cylinder portion 28 are inserted into the coupling tube 29 to prevent them from being separated, thus completing the assembly work of the starter S as shown in FIG. 3.

Next, the start of the model engine E will be explained.

First, FIG. 3 shows the starter rope 32 being wound up around the pulley 41. When the starter rope 32 is drawn out at this state, the pulley 41 is rotated to cause in turn the hub 51 to rotate while an urging force to rewind the starter rope 32 is stored up in the return spring 34.

In this way, even when the hub 51 is rotated, the starter shaft 61 is being prevented by the ball 81 urged by the coil spring 86 from rotating together with the hub 51. On the other hand, the pin 71 is pressed by the inclined rear guide face 55*a* to proceed or move toward the coupling pin P side of the model engine E.

Then, the actuator arm 64 comes into abutment to the crankshaft C and in engagement with the coupling pin P. When the coupling pin P is inserted into the recess 64*a* in the actuator arm 64, the pin 71 abuts against the parallel face 55*b* to exert a load onto the starter shaft 61 such that the starter shaft 61 is rotated together with pulley 41 and the hub 51 to turn the crank shaft C, thus starting the model engine E.

It is to be noted that the revolution of the crankshaft C is faster than that of the hub 51 once the model engine starts. In other words, the slower revolution of the hub 51 than the crank shaft C causes the pin 71 to be guided by the front guide face (slanting front guide face) 54 such that the starter shaft 61 is forcibly moved (receded) into a direction away from the crankshaft up to the original position to bring the jutting actuator 64 out of engagement with the coupling pin P.

Consequently, when the force to draw out the starter rope 32 is relieved after the model engine E is started, the starter rope 32 is wound around back onto the pulley 41 by the urging force stored up in the return spring 34 to bring the model engine E in a standby position.

It is to be noted that when the failure to start the model engine causes the starter rope 32 to be rewound onto the pulley 41 by the urge stored up in the return spring 34 and the hub 51 is caused to rotate in a direction opposite to the direction to start the model engine E such that the pin 71 is guided by the front guide face (slanting front guide face) 54 to forcibly move (recede) the starter shaft 61 away from the crank shaft C to the original position, thus bringing the model engine E in a standby position.

As mentioned above, in which one embodiment of the invention is explained, the provision of the front guide face (slanting front guide face) 54 and the rear guide face to guide the pin 71 attached to the starter shaft 61 causes the pin 71 to move along the front guide face 54 such that the engagement of the actuator arm 64 and the coupling pin P is quickly released.

Therefore, there is no chance of power loss in the model engine E.

Further, the rear guide face 55 includes the axially parallel face 55*b* in the inclined groove 53 at a position remote from the coupling pin P, contributing to the transmission of the driving power of the rotary drive mechanism 31 reliably to the crankshaft C of the model engine E.

Further, the abutment of the ball 81 against the circumferential face including the D-shaped cutout 62 under the urge of the coil spring 86 and the screw 87 helps prevent the hub 51 and the starter shaft 61 from rotating together in the absence of resistance to the actuator 64.

Consequently, the model engine E is positively started by moving positively the starter shaft 61.

Further, the structure of the rotary drive mechanism composed of the starter rope 32 to rotate the pulley 41 and the return spring 34 having the urge stored up to rewind the starter rope 32 back onto the pulley 41 at the time of drawing out the starter rope 32 assures that the return spring 34 causes the starter rope 32 to be wound up onto the circumferential face of the pulley 41 while the hub 51 is rotated in a direction opposite to the direction to start the model engine E.

Therefore, the front guide face (slanting front guide face) 54 in facing relation to the slanting rear guide face 55*a* of the rear guide face 55 defining the slanting guide groove 53 restores the pin 71 to the original position with the result that the model engine is positively started by drawing out again the starter rope 32.

Figure 5:
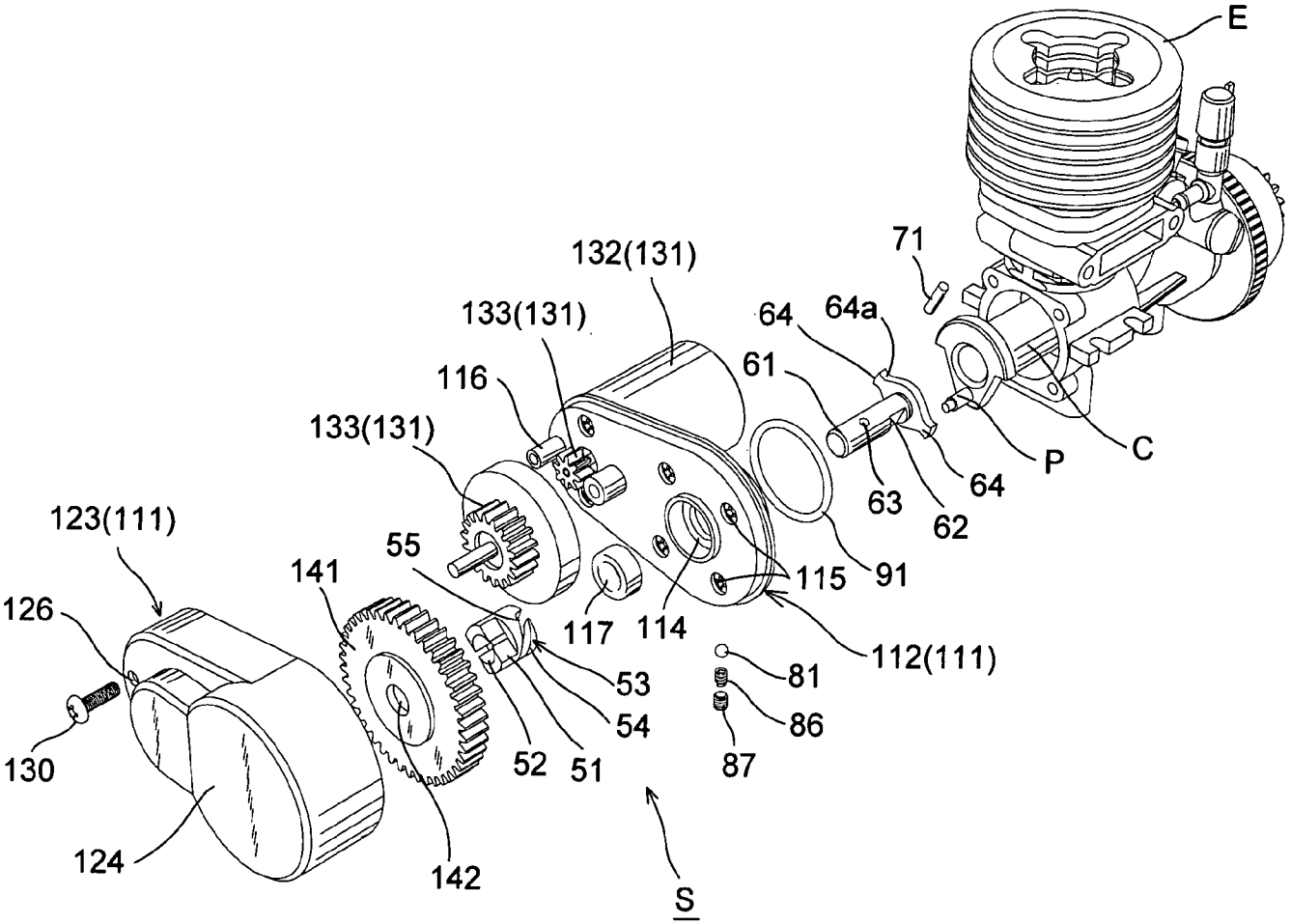
FIG. 5 is an exploded perspective view of another embodiment of the starter of the model engine according to the present invention.

FIG. 5 is an exploded perspective view of the model engine starter in accordance with another embodiment of the present invention.

Referring to FIG. 5, the starter S to start the model engine is composed of a housing 111, a rotary drive mechanism 131, a gear 141 as a rotary body to be rotated by said rotary drive mechanism 131, a hub 51 adapted to rotate together with said gear 141 and formed with an inclined guide groove 53 slanting at a predetermined angle with respect to an axis thereof, a starter shaft 61 rotatably inserted through said hub 51, a pin 71 mounted to said starter shaft 61 to move in the direction of the axis of said hub 51 along the front guide face 54 and the rear guide face 55 which define the inclined guide groove 53, an actuator arm 64 functioning as a drive member to detachably engage a connecting pin P provided in the crankshaft C, a ball 81 accommodated in a screw hole 122 of the housing 111 to slidably contact the circumferential face of the starter shaft 61 including the D-shaped cutout 62 formed in the starter shaft 61, bias means (the coil spring 86 and the screw 87) to urge said ball 81 against the circumferential face of the starter shaft 61 to prevent the hub 51 and the starter shaft 61 from rotating together when no resistance is exerted to the jutting actuator 64 and an O-ring 91.

It is to be noted that explanations are omitted for the hub 51 through the O-ring 91 exclusive of the rotary drive mechanism 131 and the gear 141 have similar structures to that shown in FIG. 1 through FIG. 4.

Further, members in the housing 123 which have similar functions to those in the housing 23 in the previous embodiment are denoted with the corresponding numerals of the housing 23 and explanations thereof are omitted.

Said housing 111 is composed of a front planar housing section 112, a rear bowl member 123 corresponding to the front housing section 112 and a fastening screw 130 to secure said rear bowl member 123 to the front housing section 112.

Then, the front housing section 112 is provided with a cylindrical portion (not shown).

Said front housing section 112 is in turn provided with a bore 114 having a circular cross section, with which said cylindrical portion communicate, a mounting hole 115 for mounting the front housing section 112 to the model engine E and a boss 116 having a screw hole therein for securing said rear bowl member 123 to said front housing section 112.

Although not shown, said cylindrical portion is provided on the opposite side of said rear bowl section 123 with cylindrical recesses coaxial with the bore 114, an O-ring groove which is circumferentially extending and screw holes communicating from said O-ring groove to the bore 114.

It is to be noted that there is provided a bearing 117 to be attached into the bore 114 rearwardly of said screw holes so as not to axially move. The starter shaft 61 is inserted into said bearing 117 from said bore 114.

Next, the rear bowl section 123 is formed with a screw hole 126 in correspondence with said screw hole in the boss 116.

Next, there is provided a rotary drive mechanism 131 composed of a motor 132 mounted on the front housing section 112 and a transmission mechanism 133 to transmit the rotary power of the motor 132 to the gear 141 through the speed reduction.

Next, the gear 141 as a rotary member is provided with a mounting bore 142 into which the hub 51 is inserted so as not to rotate.

Since the assembly of the starter S and the start (operation) of the model engine is similar to the previous embodiment, explanation thereof will be omitted.

In this embodiment, the similar effects are obtained to the previous embodiment.

Although the above mentioned embodiment shows one end (front end) of the inclined guide groove being open, said inclined guide groove may be closed at its end. In such case, the pin 71 may be inserted into the mounting hole 63 from the inclined guide groove.

Further, although the actuator arm 64 is provided integrally to the starter shaft 61 in the interest of strength, a separate actuator arm may be mounted the starter shaft 61 if the strength requirement is met.

Since the hub in the present invention is provided with a front guide face and a rear guide face to guide the pin mounted to the starter shaft, the start of the model engine causes the pin to move along the front guide face such that the drive section and the coupling pin are disengaged quickly.

Therefore, there is no time period during which power loss is caused in the model engine.

Further, the provision of a parallel face in parallel to the axis in the rear guide face remote from the coupling pin in the inclined guide groove has made it possible to transmit the driving power from the rotary drive mechanism positively to the crankshaft of the model engine.

Further, the ball pressed against the circumferential face of the starter shaft inclusive of a D-shaped cutout by the urge of biasing means causes the actuator arm to come into engagement with the coupling pin provided in the crankshaft of the model engine until the driving power is transmitted thereto, in other words, when resistance is not given to the actuator to prevent the hub and the starter shaft from rotate together.

Therefore, the starter shaft is positively moved to start the model engine positively.

Further, the rotary drive mechanism is composed of a starter rope to rotate the rotary member and a return spring to rewind the starter rope back onto the circumferential face of the rotary member when the starter rope is to be drawn out. When an attempt to draw out the starter rope to start the model engine is unsuccessful, the force to draw out the starter rope is relieved with the result that said return spring causes the starter rope to be rewound on the circumferential face while the hub is rotated in a opposite direction to the one into which the model engine is started.

Therefore, the front guide face opposite the inclined guide face in the rear guide face to define the inclined guide groove restores the pin to the original position. As a result, the model engine is started by pulling again the starter rope.

What is claimed is:

1. A starter assembly for a model engine which is adapted to engage a coupling pin on a crankshaft of the model engine, the starter assembly comprising a starter shaft carrying a starter pin and having forward and rearward end portions defining therebetween a shaft axis;

a hub having a bore in which said forward end portion of the starter shaft is received to allow for rotation of the starter shaft relative to the hub, and a guide groove which is slanted at a predetermined angle with respect to the shaft axis; and an actuator attached to said rearward end portion of the starter shaft which is adapted to being brought into and out of engagement with the coupling pin of the model engine crankshaft, wherein said guide groove includes an open proximal end and a closed distal end and is defined by opposed front and rear guide faces each of which is slanted at said predetermined angle relative to the shaft axis, wherein said guide groove further includes a transition face which is parallel to the starter axis and is joined to said rear guide face and extends toward said proximal open end of the guide groove, wherein said front guide face terminates at said open end of the guide groove, and the rear guide face terminates at the transition face, and wherein said starter pin carried by said starter shaft is received within said guide groove so as to be moveable therewithin along said front and rear guide faces in response to rotation of the starter shaft relative to the hub so as to responsively move the starter shaft in a direction of the shaft axis and thereby move the actuator into and out of engagement with the coupling pin of the model engine crankshaft.

2. A starter assembly for a model engine as set forth in claim 1, wherein said starter shaft is formed with a D-shaped cutout, and wherein said starter assembly further comprises:

a rotary drive mechanism operatively connected to the starter shaft so as to impart rotational force to the starter shaft;

a ball slidably in contact with a circumferential face inclusive of said D-shaped cutout of said starter shaft; and a bias member for urging said ball to the circumferential face inclusive of said D-shaped cutout of said starter shaft to prevent said hub and said starter shaft from rotating together in the absence of resistance being imparted to said drive section.

3. A starter assembly for a model engine as set forth in claim 1, wherein said actuator includes an arm adapted to engage with the coupling pin of the model engine crankshaft.

4. A starter assembly for a model engine as set forth in claim 1, further comprising a rotary drive mechanism operatively connected to the starter shaft so as to impart rotational force to the starter shaft, wherein said rotary drive mechanism comprises a rotary member, a starter rope to rotate said rotary body, and a return spring having an urging force stored up to rewind said starter rope about the circumference of said rotary member when said starter rope is drawn out.

5. A starter assembly for a model engine as set forth in claim 1, further comprising a rotary drive mechanism operatively connected to the starter shaft so as to impart rotational force to the starter shaft, wherein said rotary drive mechanism comprises a rotary member, a motor, and a transmission mechanism to transmit a turning force of said motor to said rotary member.

* * * * *